US009849056B2

(12) United States Patent
Chen

(10) Patent No.: US 9,849,056 B2
(45) Date of Patent: Dec. 26, 2017

(54) SEATED INVERSION TABLE

(71) Applicant: Zhongshan Yingliang Health Technology Co., Ltd, Zhongshan, Guangdong Province (CN)

(72) Inventor: Chih-Liang Chen, Taoyuan (TW)

(73) Assignee: Zhongshan Yingliang Health Technology Co., Ltd., Zhongshan (CN)

( * ) Notice: Subject to any disclaimer, the term of this patent is extended or adjusted under 35 U.S.C. 154(b) by 0 days.

(21) Appl. No.: 15/201,683

(22) Filed: Jul. 5, 2016

(65) Prior Publication Data

US 2017/0128309 A1 May 11, 2017

(30) Foreign Application Priority Data

Nov. 9, 2015 (TW) ..... 104217926 U

(51) Int. Cl.

| | |
|---|---|
| ***A61H 1/02*** | (2006.01) |
| ***A47C 13/00*** | (2006.01) |
| ***A47C 7/58*** | (2006.01) |
| ***A47C 7/42*** | (2006.01) |
| ***A47C 7/52*** | (2006.01) |
| ***A47C 7/50*** | (2006.01) |

(52) U.S. Cl.

CPC ..... *A61H 1/0229* (2013.01); *A47C 7/42* (2013.01); *A47C 7/506* (2013.01); *A47C 7/52* (2013.01); *A47C 7/58* (2013.01); *A47C 13/00* (2013.01); *A61H 2203/0493* (2013.01); *A61H 2205/081* (2013.01)

(58) Field of Classification Search

CPC .. A47C 7/42; A47C 7/506; A47C 7/52; A47C 7/58; A47C 13/00; A61H 1/0229; A61H 2203/0493; A61H 2205/081

See application file for complete search history.

(56) References Cited

U.S. PATENT DOCUMENTS

| | | | | |
|---|---|---|---|---|
| 6,679,818 | B2 * | 1/2004 | Hsien | A63B 21/068 482/144 |
| 7,361,128 | B2 * | 4/2008 | Chen | A61H 1/0218 482/142 |
| 8,056,979 | B2 * | 11/2011 | McBride | A47C 1/02 297/326 |
| 2013/0029816 | A1 * | 1/2013 | Park | A61H 1/0218 482/142 |

(Continued)

FOREIGN PATENT DOCUMENTS

TW M298454 U 10/2006

*Primary Examiner* — Philip Gabler

(74) *Attorney, Agent, or Firm* — Alan D. Kamrath; Kamrath IP Lawfirm, P.A.

(57) ABSTRACT

The seated inversion table is provided having a support frame assembly, and a seat back assembly, and a seat cushion assembly tiltably mounted on the support frame assembly. The seat back assembly connects to the seat cushion assembly and connects to a rotating frame assembly through a lower connecting tube assembly. The rotating frame assembly is tiltably mounted on the seat cushion assembly and is adjustably mounted on a foot-clamping frame. With a front swinging rod of the seat cushion assembly tiltably mounted on the support frame assembly, a range of an inversion angle is restricted and thereby the seated inversion table may not over tilt.

20 Claims, 11 Drawing Sheets

(56) References Cited

U.S. PATENT DOCUMENTS

| | | | | |
|---|---|---|---|---|
| 2015/0164730 | A1* | 6/2015 | Chen | A61H 1/0222<br>482/144 |
| 2015/0305962 | A1* | 10/2015 | Noel | A61H 1/0229<br>602/36 |

* cited by examiner

SEATED INVERSION TABLE

CROSS-REFERENCE TO RELATED APPLICATIONS

This application is based upon and claims priority under 35 U.S.C. 119 from Taiwan Patent Application No. 104217926 filed on Nov. 9, 2015, which is hereby specifically incorporated herein by this reference thereto.

BACKGROUND OF THE INVENTION

1. Field of the Invention

The present invention relates to a seated inversion table, especially to a seated inversion table that can prevent a user from over-inverting when using the seated inversion table.

2. Description of the Prior Arts

A seated inversion table is used for relieving discomfort caused by osteophytes, commonly referred to as bone spurs or parrot beak. In other words, the seated inversion table is rehabilitation equipment that allows a patient to appropriately exercise on it for stretching the abdominal muscles and back muscles.

According to Taiwan Patent No. M298454, the conventional seated inversion table is provided with a seat cushion assembly tiltably mounted between a front support component and a rear support component, a center of a first rod of the seat cushion assembly is mounted on an extendable rod, and two end portions of the first rod are tiltably mounted on two inner surfaces of two opposite ends of the rear support component which face to each other. The extendable rod is connected to a connecting tube through a second rod. The second rod is located under a sitting cushion of the seat cushion assembly. A center of the connecting tube is tiltably mounted on a connecting frame, and two opposite ends of the connecting tube are tiltably mounted on a hanging portion of the rear support component. The connecting frame is securely mounted on a rear surface of the back cushion.

When the patient performs inversion on the seated inversion table, the spaces between vertebras can be extended, aches caused by the osteophytes pressing on neurons are relieved, and abdominal muscles and back muscles stretch and get exercise at the same time. When the user sits on the seated inversion table and uses it, the back of the user lies against the seat back, the feet hook on the foot-clamping frame assembly, and the hands hold on and push the handle bars until the body tilts backward 180 degrees.

However, the conventional seated inversion table is not disposed with any protective structure for preventing the seated inversion table from over tilting. Thus, because the two end portions of the first rod are tiltably mounted on the two inner surfaces of two opposite ends of the rear support component which face to each other, when the user over tilts with the seat cushion assembly, the conventional seated inversion table cannot stop the inertia of inverting by the first rod abutting on the handle bars, which increases the possibility of injury to the user.

In addition, because a distance between two fixing rods of the foot-clamping frame assembly of the conventional seated inversion table is hard to adjust when the user sits on a sitting cushion of the seated inversion table, the user's foot cannot hook on the fixing rods firmly.

Besides, because the seated inversion table is designed for the particular purpose, the seated inversion table is not suitable for other purposes. When the seated inversion table is not in use, it is not easy to store the seated inversion table in the limited housing space of densely populated metropolitan area.

To overcome the shortcomings, the present invention provides a seated inversion table to mitigate or obviate the aforementioned problems.

SUMMARY OF THE INVENTION

The main objective of the present invention is to provide a seated inversion table that can restrict and stop inertia during inversion to protect the user.

The seated inversion table has:

- a support frame assembly comprising:
  - at least one rear support component,
  - at least one front support component connected to the at least one rear support component, and
  - a connecting tube, two opposite ends of the connecting tube securely mounted on the at least one front support component;
- a seat back assembly comprising:
  - a rear swinging rod, two opposite ends of the rear swinging rod tiltably mounted on the support frame assembly,
  - a rear-rod-tilting frame tiltably mounted at a center of the rear swinging rod, and
  - a back cushion securely mounted at one end of the rear-rod-tilting frame;
- a seat cushion assembly comprising:
  - a front swinging rod, two opposite ends of the front swinging rod tiltably mounted on the support frame assembly,
  - a cushion bottom rod, one end of the cushion bottom rod securely mounted on the rear swinging rod of the seat back assembly, and another end of the cushion bottom rod securely mounted on the front swinging rod, and
  - a sitting cushion movably mounted on the cushion bottom rod and the cushion bottom rod located on a bottom surface of the sitting cushion;
- a lower connecting tube assembly comprising:
  - a lower connecting tube located on the bottom surface of the sitting cushion, one end of the lower connecting tube securely mounted at another end of the rear-rod-tilting frame of the seat back assembly,
  - a guiding stand mounted on an outer surface of the lower connecting tube, and
  - a band, one end of the band securely mounted on the connecting tube of the support frame assembly and detoured around the guiding stand;
- a rotating frame assembly comprising:
  - a connecting frame tiltably mounted at a center of the front swinging rod of the seat cushion assembly, another end of the lower connecting tube securely mounted on the connecting frame, another end of the band mounted on the connecting frame, and
- a foot-clamping frame assembly securely mounted on the rotating frame assembly, and being adjustable in angle and distance relative to the rotating frame assembly.

One of the advantages of the present seated inversion table is that with the front swinging rod tiltably mounted on the support frame assembly, the front swinging rod will be located at an end of the stroke and abut on the upper bars when the user performs inversion on the seated inversion table. Thus, a range of an inversion angle is restricted and thereby the seated inversion table may not over tilt.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
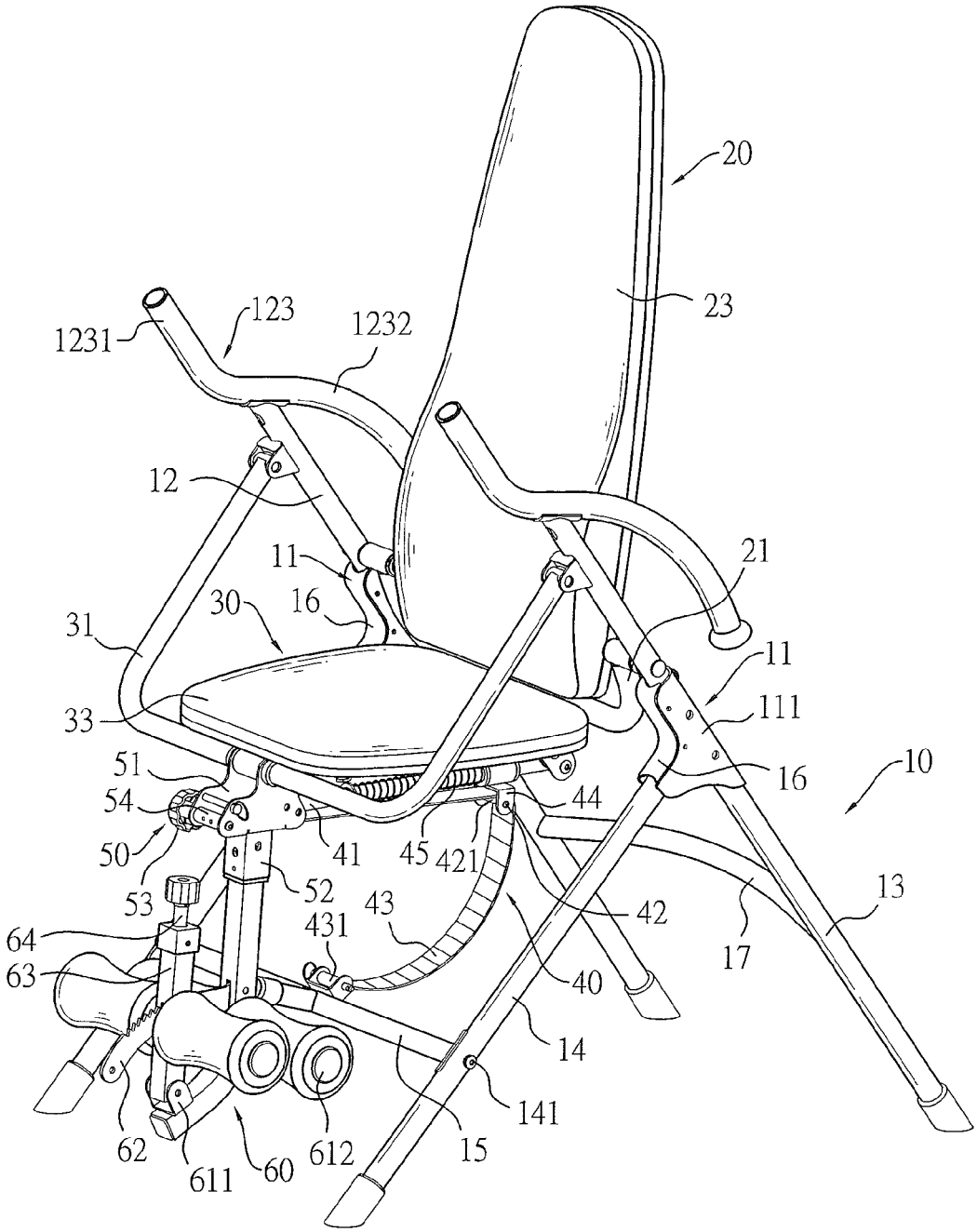
FIG. 1 is a perspective view of a seated inversion table in accordance with the present invention.

With reference to FIG. 1, a seated inversion table in accordance with the present invention comprises a support frame assembly 10, a seat back assembly 20, a seat cushion assembly 30, a lower connecting tube assembly 40, a rotating frame assembly 50, and a foot-clamping frame assembly 60.

Figure 2:
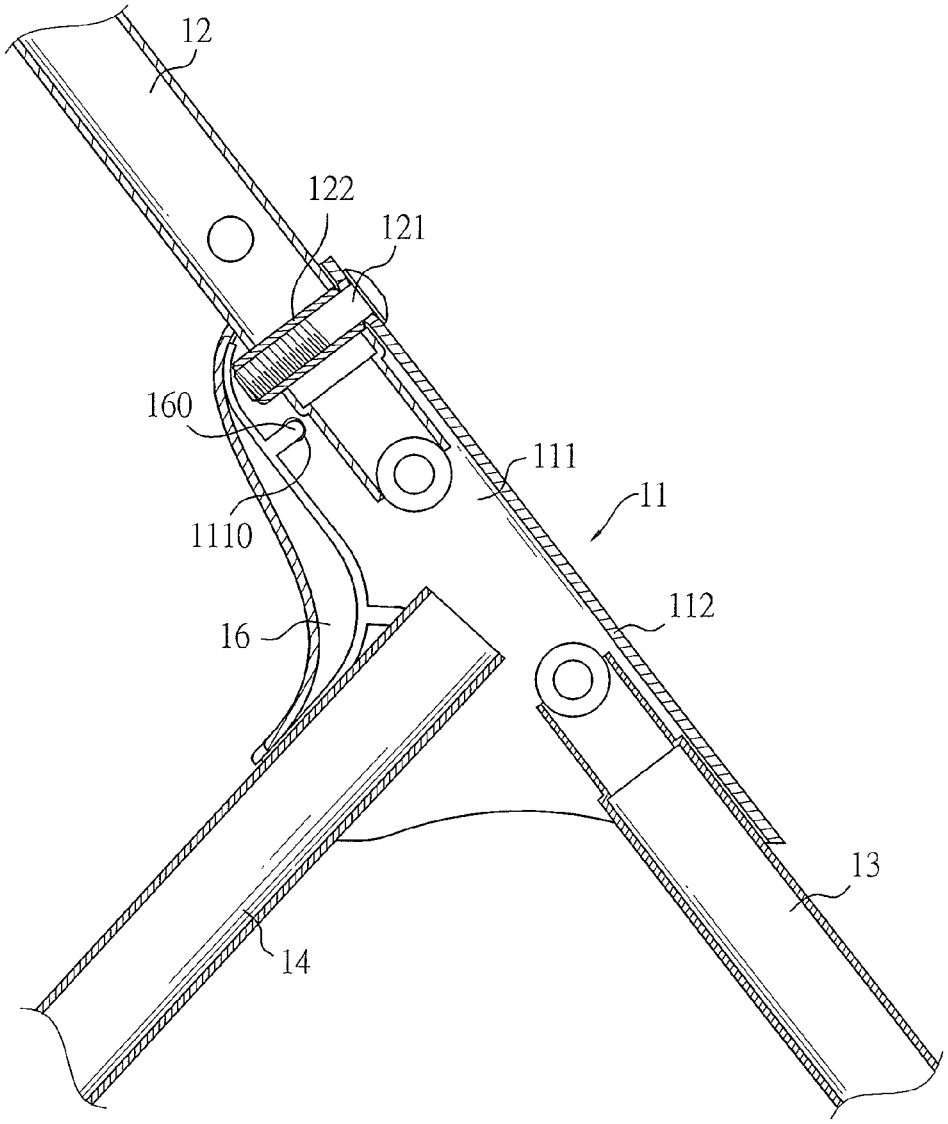
FIG. 2 is a sectional view of a pivot frame, a front support component, and a rear support component of the seated inversion table in FIG. 1.
Figure 3:
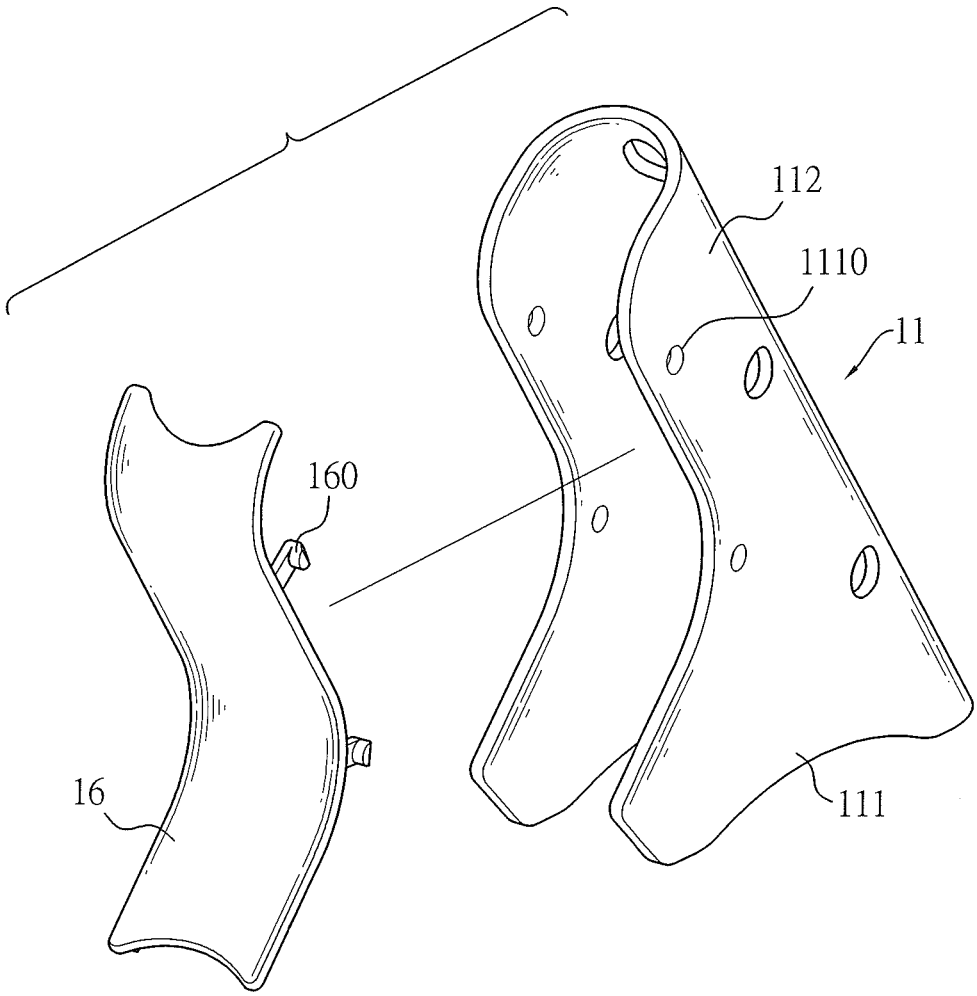
FIG. 3 is a perspective view of a pivot frame and a support cover of the seated inversion table in FIG. 1.

Please also refer to FIGS. 2 and 3. The support frame assembly 10 comprises two pivot frames 11, two handle components 12 and at least one rear support component 13 tiltably mounted on the two pivot frames 11, at least one front support component 14 securely mounted on the two pivot frames 11, and a connecting tube 15 removably mounted on the at least one front support component 14. In other words, the at least one front support component 14 is connected to the at least one rear support component 13 through the pivot frames 11.

In this embodiment, the numbers of both the at least one rear support component 13 and at least one front support component 14 are two. Each one of the two rear support components 13 and the two front support components 14 is a straight rod, an upper end of each rod is mounted on the corresponding pivot frame 11, and a lower end of each rod stands on the ground. The connecting tube 15 is removably mounted between the two front support components 14.

The two pivot frames 11 are located on two sides of the support frame assembly 10, each one of the pivot frames 11 comprises two sidewalls 111 and a connecting wall 112. The connecting wall 112 connects to and is located between the two sidewalls 111 to make the pivot frame 11 form a U-shape with a pivot space in the U-shape. An opening of the U-shape is formed between two ends of the two sidewalls 111. Two lower ends of the two handle components 12 and the two upper ends of the two rear support components 13 are tiltably mounted between the two sidewalls 111 of the two pivot frames 11 respectively.

More precisely, in this embodiment, each one of the lower ends of the handle components 12 is tiltably mounted in one end of the pivot space of the corresponding pivot frame 11, and each one of the upper ends of the rear support components 13 is mounted in the other end of the pivot space of the corresponding pivot frame 11. The lower ends of the handle components 12 and the upper ends of the rear support components 13 are capable of pivoting in the pivot space. In other words, the handle components 12 and the rear support components 13 tilt about different axes. The lower ends of the two handle components 12 and the upper ends of two rear support components 13 selectively abut against the connecting wall 112 of the corresponding pivot frame 11, and when the handle components 12 and the rear support components 13 abut against the connecting walls 112, each one of the handle components 12 and the corresponding rear support component 13 are disposed in the same straight line.

According to FIG. 3, in this embodiment, the support frame assembly 10 further comprises two support covers 16 removably mounted on the two pivot frames 11 respectively. Each support cover 16 is located between the corresponding handle component 12 and the corresponding front support component 14. More precisely, each one of the support covers 16 is located in the opening of the corresponding pivot frame 11 and between the sidewalls 111 of the corresponding pivot frame 11, and the support covers 16 shelter the pivot spaces respectively. Each one of the support covers 16 forms a plurality of protrusions 160 on an edge of the support cover 16, and the sidewalls 111 of each one of the two pivot frames 11 form a plurality of recesses 1110. The protrusions 160 selectively engage with the recesses 1110 respectively. When the protrusions 160 engage with the recesses 1110, the support cover 16 shelters the corresponding pivot space, so as to prevent the corresponding handle component 12 and the corresponding front support component 14 tilting with respect to each other and prevent foreign objects from falling into the pivot space and obstructing tilting and later storage.

Figure 4:
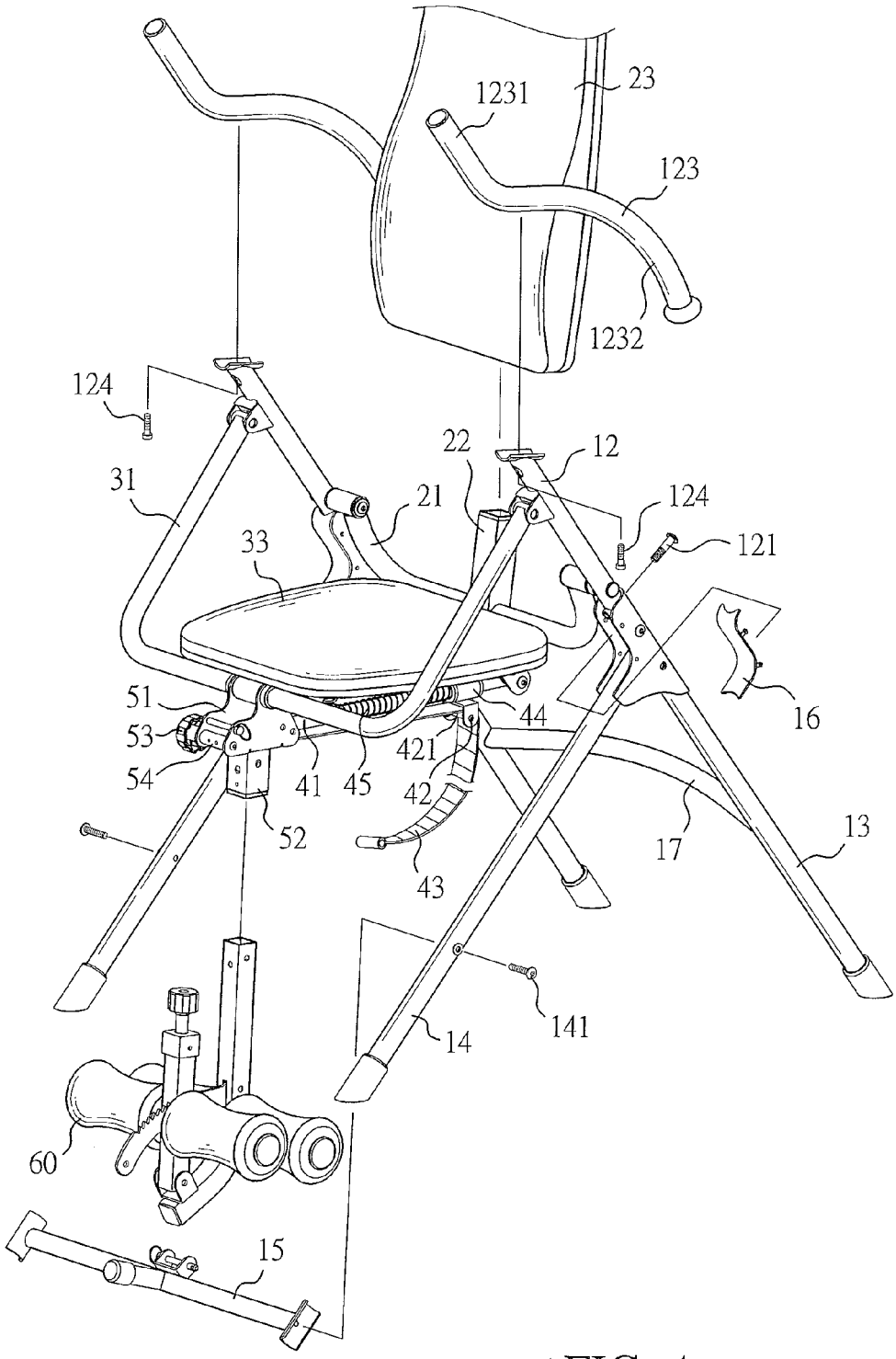
FIG. 4 is an exploded view of the seated inversion table in FIG. 1.

According to FIGS. 2 and 4, each one of the handle components 12 comprises a first fixing element 121, a first sleeve 122, a handle bar 123 and a second fixing element 124. The two first fixing elements 121 are removably mounted through the two pivot frames 11 and adjacent to the lower ends of the handle components 12 (as shown in FIG. 2), and the two second fixing elements 124 are removably mounted through the two handle bars 123 and upper ends of the two handle components 12 (as shown in FIG. 4). The first fixing elements 121 and the second fixing elements 124 may be screws or pins, but hereinafter the first fixing elements 121 and the second fixing elements 124 are elaborated as screws in this embodiment.

The two first sleeves 122 are securely mounted adjacent to the lower ends of the two handle components 12 respectively, and the two first fixing elements 121 are removably screwed into the two first sleeves 122 respectively. When penetrating through the connecting wall 112, each first fixing element 121 abuts against the connecting wall 112 and is screwed into the corresponding first sleeve 122 respectively, and each one of the handle components 12 may not tilt with respect to the corresponding pivot frame 11.

The two handle bars 123 are removably mounted on the upper ends of the two handle components 12 respectively, and each one of the handle bars 123 comprises a second sleeve (not illustrated in the drawings). The two second fixing elements 124 are removably screwed into the second sleeves of the two handle bars 123 respectively. When penetrating through the corresponding handle component 12, each second fixing element 124 abuts against an inner surface of the corresponding handle component 12 and is screwed into the corresponding second sleeve respectively, and each one of the handle bars 123 is fixed on the upper end of the corresponding handle component 12. Each one of the handle bars 123 comprises an upper bar 1231 and a lower bar 1232.

Each one of the two front support components 14 comprises a third fixing element 141 removably mounted through the corresponding front support component 14 and the connecting tube 15. The third fixing elements 141 also can be screws or pins. In this embodiment, when penetrating through the corresponding front support component 14, the two third fixing elements 141 are screwed into two ends of the connecting tube 15 respectively, and the connecting tube 15 is fixed between the two front support components 14.

The support frame assembly 10 further comprises a curved tube 17 mounted between the two rear support components 13. The curved tube 17 is curved backward.

Then refer to FIGS. 1 and 4. The seat back assembly 20 comprises a rear swinging rod 21, a rear-rod-tilting frame 22 and a back cushion 23. The rear swinging rod 21 is a U-shaped rod, and two opposite ends of the U-shaped rod are tiltably mounted adjacent to the lower ends of the two handle components 12 respectively. A center of the rear-rod-tilting frame 22 is tiltably mounted at a center of the U-shaped rear swinging rod 21. The back cushion 23 is removably mounted at an upper end of the rear-rod-tilting frame 22 with screws or pins.

Figure 7:
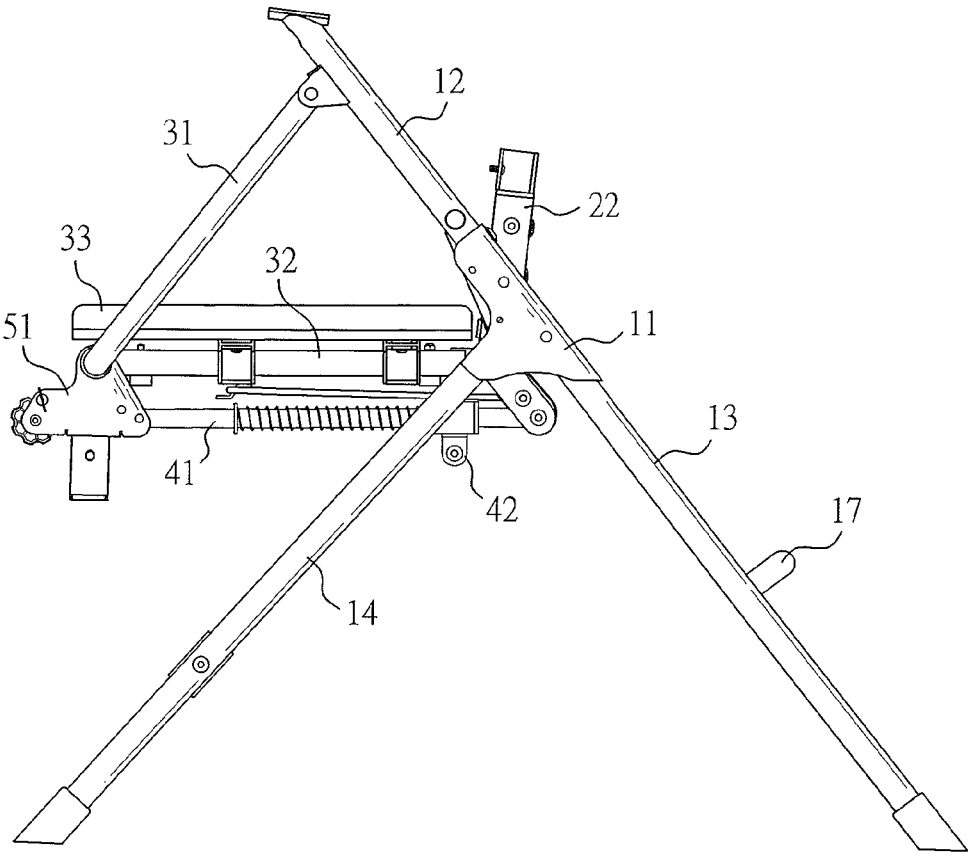
FIGS. 7-9 are serial operational views of the seated inversion table in FIG. 1.

Please also refer to FIG. 7. The seat cushion assembly 30 comprises a front swinging rod 31, a cushion bottom rod 32 and a sitting cushion 33. The front swinging rod 31 is a U-shaped rod, and two ends of the U-shaped rod are tiltably mounted adjacent to the upper ends of the two handle components 12 respectively. One end of the cushion bottom rod 32 is securely mounted at the center of the rear-rod-tilting frame 22, and said end is located under the rear swinging rod 21; the other end is securely mounted at a center of the U-shaped front swinging rod 31. The sitting cushion 33 is movably mounted on the cushion bottom rod 32, and the cushion bottom rod 32 is located on a bottom surface of the sitting cushion 33. In another embodiment, the number of the cushion bottom rod 32 can be two or more, and the cushion bottom rods 32 are equidistantly spaced apart from each other.

Figure 5:
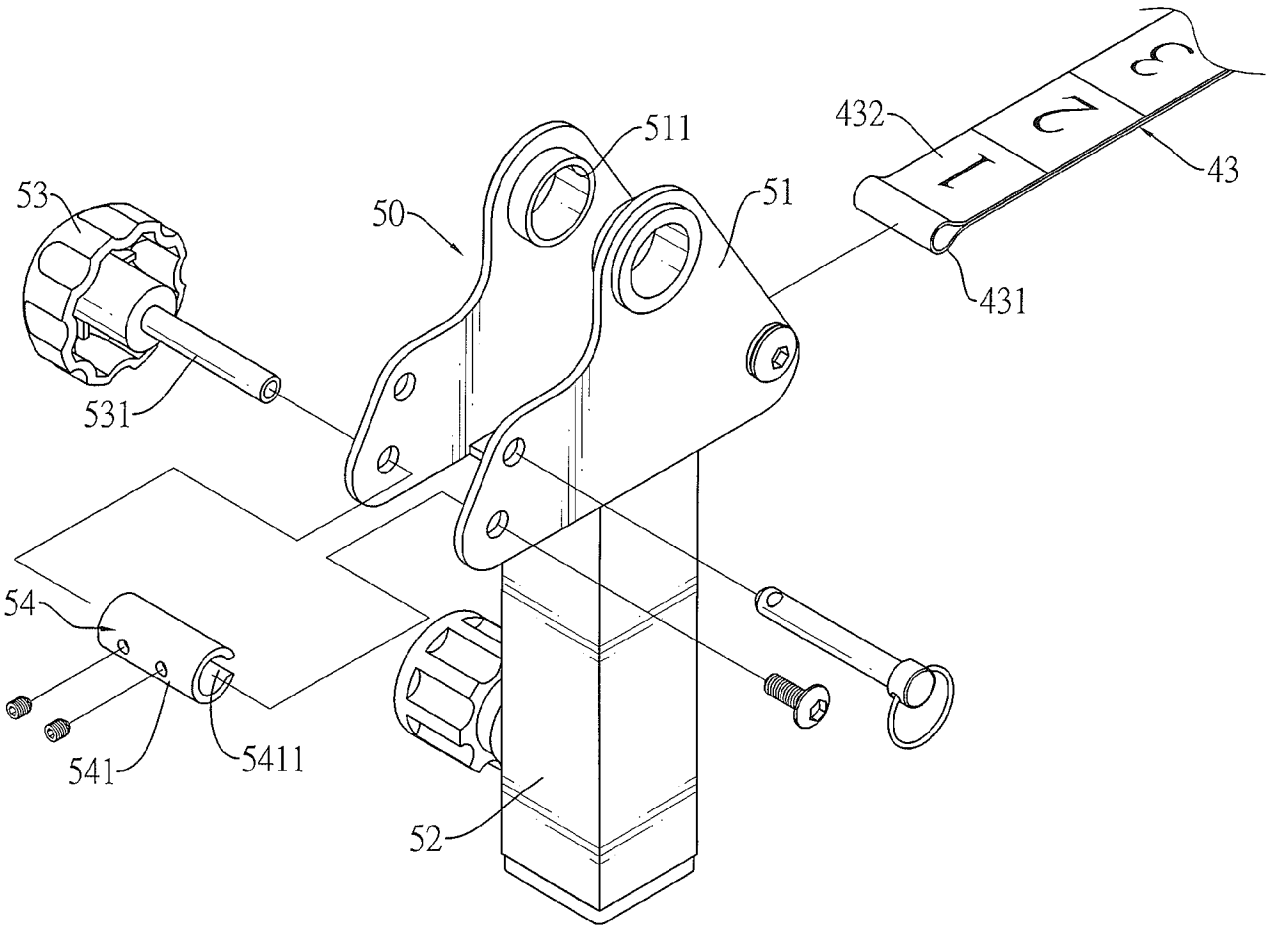
FIG. 5 is an exploded view of the rotating frame assembly in FIG. 1.

Please refer to FIGS. 1, 4 and 5. The lower connecting tube assembly 40 comprises a lower connecting tube 41, a guiding stand 42, a band 43, a sleeve component 44 and a spring 45. The lower connecting tube 41 is located on the bottom surface of the sitting cushion 33, and one end of the lower connecting tube 41 is securely mounted at a lower end of the rear-rod-tilting frame 22. The guiding stand 42 is movably mounted on an outer surface of the lower connecting tube 41 and comprises a roller 421 pivotably mounted therein. One end of the band 43 is securely mounted on the connecting tube 15, and a middle of the band 43 is detoured around the guiding stand 42. Thus, the band 43 can be fixed securely and may not droop to the ground when the present seated inversion table is being inverted. The band 43 has a plurality of separate marks 432 on a surface of the band 43. The other surface of the band 43 is laid on an outer surface of the roller 421. The sleeve component 44 movably sleeves the lower connecting tube 41, and the guiding stand 42 is securely mounted on an outer surface of the sleeve component 44. The spring 45 sleeves the lower connecting tube 41. One end of the spring 45 abuts on the sleeve component 44, and the other end of the spring 45 abuts on the outer surface of the lower connecting tube 41.

Please refer to FIG. 5. The rotating frame assembly 50 comprises a connecting frame 51, an assembling tube 52, a knob 53 and an adjusting component 54. The connecting frame 51 is mounted at the center of the front swinging rod 31. The other end of the lower connecting tube 41 is securely mounted on the connecting frame 51, and said end is opposite the end of the lower connecting tube 41 that is securely mounted at the rear-rod-tilting frame 22. The other end of the band 43 comprising a sleeving portion 431 is mounted on the connecting frame 51, and said end is opposite the end of the band 43 that is securely mounted on the connecting tube 15. The connecting frame 51 has two separate but connected sheet bodies and comprises two rod stands 511 laterally mounted through the two sheet bodies respectively and pivotably mounted in the front swinging rod 31. The rod stands 511 correspond to each other in locations.

One end of the assembling tube 52 is securely mounted on a bottom of the connecting frame 51. The knob 53 has a stick 531 protruding from a surface of the knob 53 and penetrating through the connecting frame 51.

The adjusting component 54 is pivotably mounted in the connecting frame 51 and includes a casing 541. The casing 541 is a hollow tube and is mounted around the stick 531. The casing 541 forms an elongate opening 5411 corresponding to an inside of the casing 541. The band 43 penetrates the elongate opening 5411 and the sleeving portion 431 of the band 43 is inside the casing 541 and is mounted around an outer surface of the stick 531.

Figure 6:
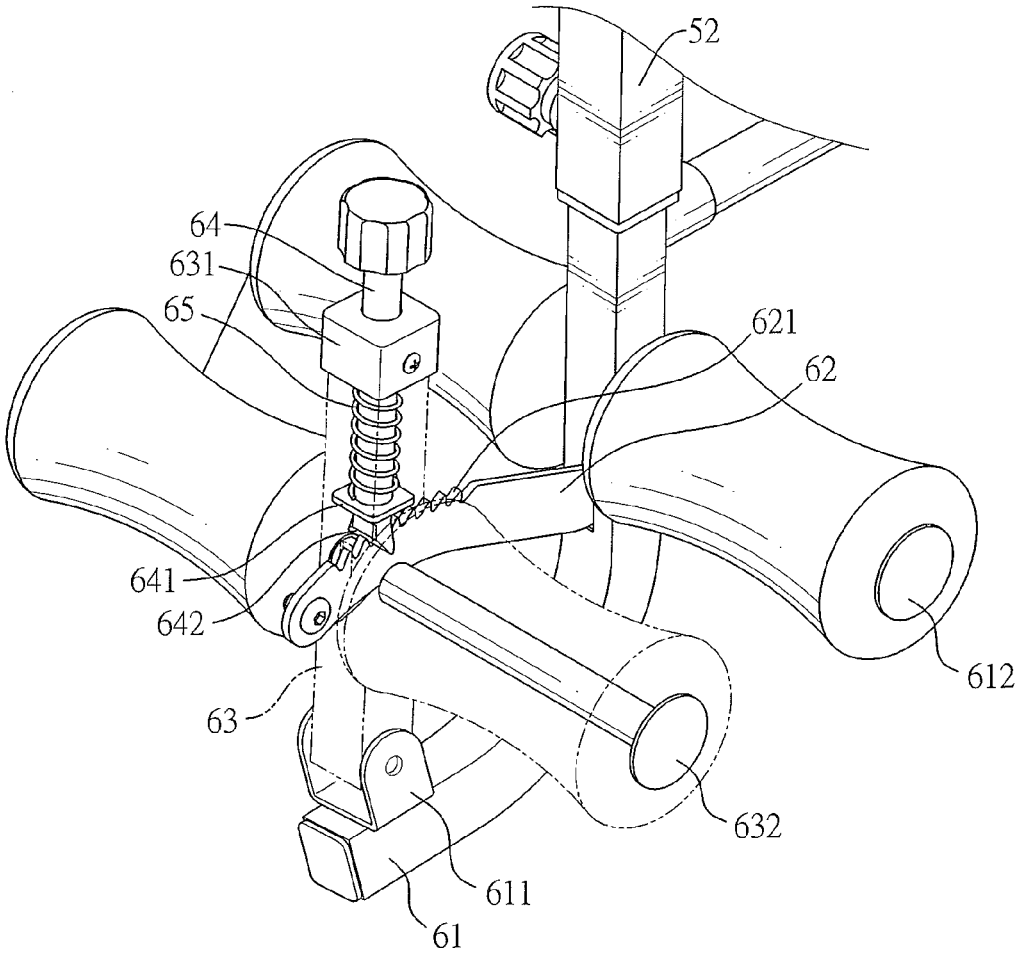
FIG. 6 is a perspective view of the foot-clamping frame assembly in FIG. 1.

Please refer to FIGS. 1, 4 and 6. The foot-clamping frame assembly 60 is adjustably and removably mounted on the connecting frame 51 through the assembling tube 52 and can abut on the support frame assembly 10. The foot-clamping frame assembly 60 comprises a curved linkage tube 61, a rack piece 62, an adjusting tube 63, an adjusting rod 64, and an adjusting spring 65.

One end of the curved linkage tube 61 of the foot-clamping frame assembly 60 is a straight segment and is adjustably mounted on the assembling tube 52, and the other end of the curved linkage tube 61 forms a curved segment. The curved linkage tube 61 comprises an adjusting stand 611 and two first foot-clamping components 612. The adjusting stand 611 is mounted on a top surface of the curved segment of the curved linkage tube 61. The foot-clamping components 612 are mounted on two lateral surfaces of the straight segment of the curved linkage tube 61 respectively.

One end of the rack piece 62 is mounted on the curved linkage tube 61 and comprises a toothed portion 621 formed on an edge of the rack piece 62 and facing to the sitting cushion 33.

The adjusting tube 63 is a hollow tube and one end of the adjusting tube 63 is tiltably mounted on the adjusting stand 611. The adjusting tube 63 comprises a cover 631 and two second foot-clamping components 632. The cover 631 is mounted on the other end of the adjusting tube 63. The two second foot-clamping components 632 are mounted on two lateral surfaces of the adjusting tube 63 respectively. The second foot-clamping components 632 correspond to the first foot-clamping components 612 in locations.

The adjusting rod 64 is mounted in the adjusting tube 63, and one end of the adjusting rod 64 penetrates through the cover 631. The adjusting rod 64 comprises an obstruction portion 641 and a wedge portion 642. The obstruction portion 642 radially protrudes on an outer surface of the other end of the adjusting rod 64. The wedge portion 642 forms on said other end of the adjusting rod 64 and is engaged with the toothed portion 621 of the rack piece 62.

The adjusting spring 65 is mounted around an outer surface of the adjusting rod 64. One end of the adjusting spring 65 abuts on the obstruction portion 641, and the other end of the adjusting spring 65 abuts on the cover 631.

However, in another embodiment, the numbers of both the at least one rear support component 13 and the at least one front support component 14 are one. Each of the rear support component 13 and the front support component 14 is a U-shaped rod. The connecting tube 15 is connected between two arms of the U-shaped front support component 14. The curved tube 17 is connected between two arms of the U-shaped rear support component 13.

Figure 11:
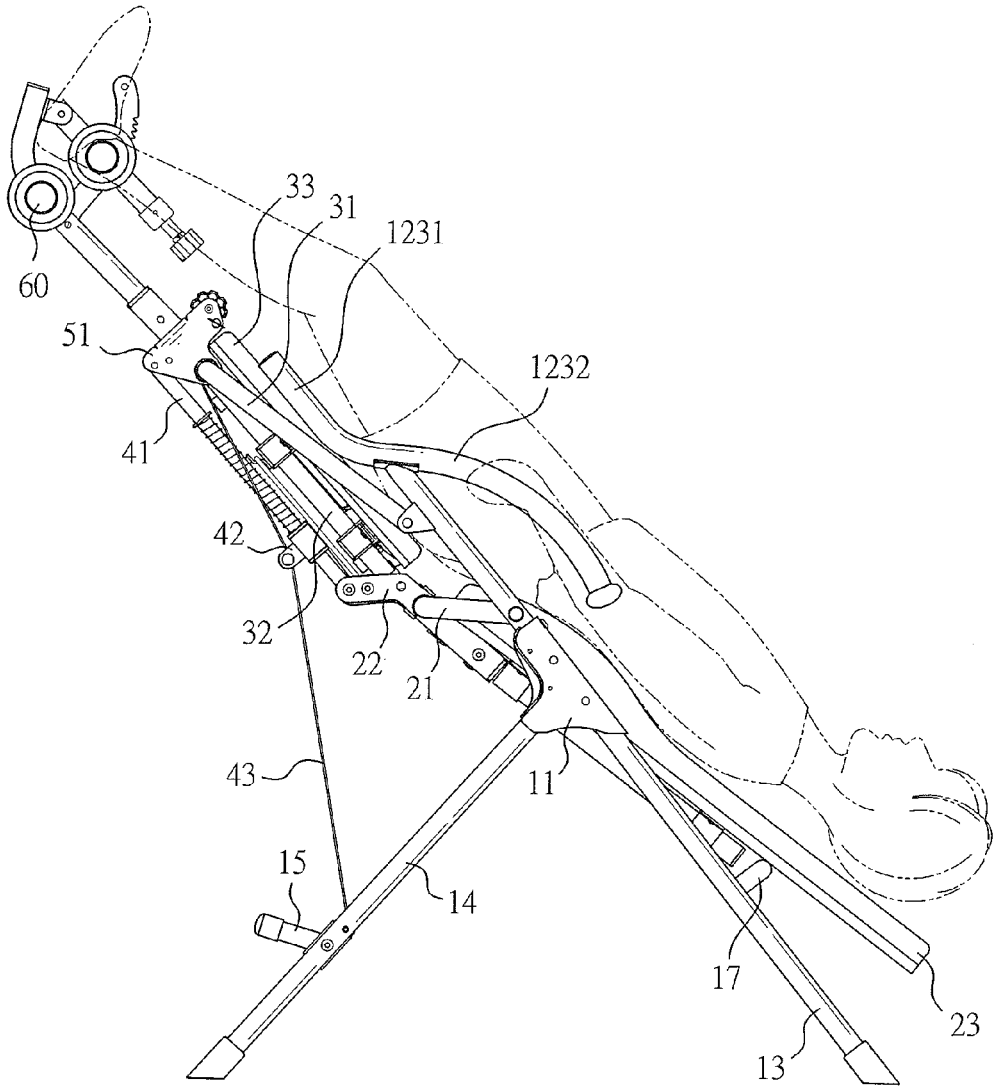
FIG. 11 is an operational schematic view of the folded seated inversion table in FIG. 1.

In accordance with FIG. 11, when a user performs inversion with the present seated inversion table, the user sits on the sitting cushion 33, the user's back lies against the back cushion 23, and the user's hands hold the upper bars 1231. Meanwhile, the user's hands push the upper bars 1231 and thereby the user's arms get exercise. Besides, when the user inclines backward with force and makes the user's back push the back cushion 23, the rear swinging rod 21 can be tilted forward, an angle between the sitting cushion 33 and the back cushion 23 is changed, and thereby the user's abdominal muscles stretch. In addition, the foot-clamping frame assembly 60 is moved away from the connecting tube 15 because the back cushion 23 pushes the lower connecting tube 41 and the connecting frame 51 through the rear-rod-tilting frame 22, the front swinging rod 31 is tilted upward with respect to the handle components 12 along with the connecting frame 51 moving forward, and the band 43 is stretched and deformed along with the connecting frame 51 moving forward, so that the user's leg muscles can be stretched. At this moment, the front swinging rod 31 is tilted toward the upper bars 1231.

With the user's hands keep pushing and shifting from the upper bars 1231 to the lower bars 1232, the rear swinging rod 21 will be tilted further and the angle between the sitting cushion 33 and the back cushion 23 is increased. At this time, the back cushion 23 pushes the lower connecting tube 41 and the connecting frame 51 through the rear-rod-tilting frame 22 so that the foot-clamping frame assembly 60 finally moves to a location above the back cushion 23, which achieves the purpose of inverting and exercising. Besides, the front swinging rod 31 abuts on the upper bars 1231 because of the driving of the connecting frame 51, and the band 43 is stretched completely because of being dragged by the connecting frame 51. Thus, the present seated inversion table may not be tilted toward the same direction further at this time.

Then refer to FIGS. 4 and 7 to 9. FIG. 4 illustrates storage process of the present seated inversion table after the exercise. First, the user can remove the handle bars 123, the connecting tube 15, the support covers 16, the back cushion 23, and the foot-clamping assembly 60. More precisely, after the second fixing elements 124 are removed, the handle bars 123 can be removed; after the third fixing elements 141 are removed, the connecting tube 15 can be removed. After the aforesaid components are removed, the seated inversion table is as shown in FIG. 7. Then after the first fixing elements 121 are removed, the two handle components 12 and the two rear support components 13 can be tilted.

Figure 8:
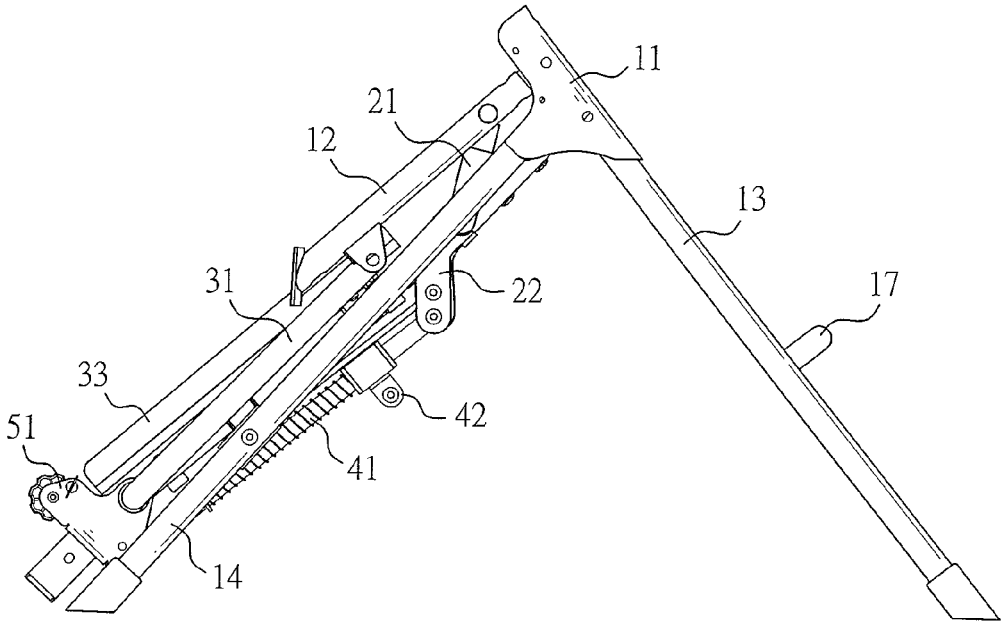

After that, as shown in FIG. 8, the handle components 12 are tilted forward until the handle components 12 are parallel to the front support components 14. Then the rear swinging rod 21 and the front swinging rod 31 are tilted forward, making the sitting cushion 33 move forward and the front swinging rod 31 and the sitting cushion 33 parallel to the front support components 14. Then the upper end of the rear-rod-tilting frame 22 is tilted backward, making the connecting frame 51 tilt forward.

Figure 9:
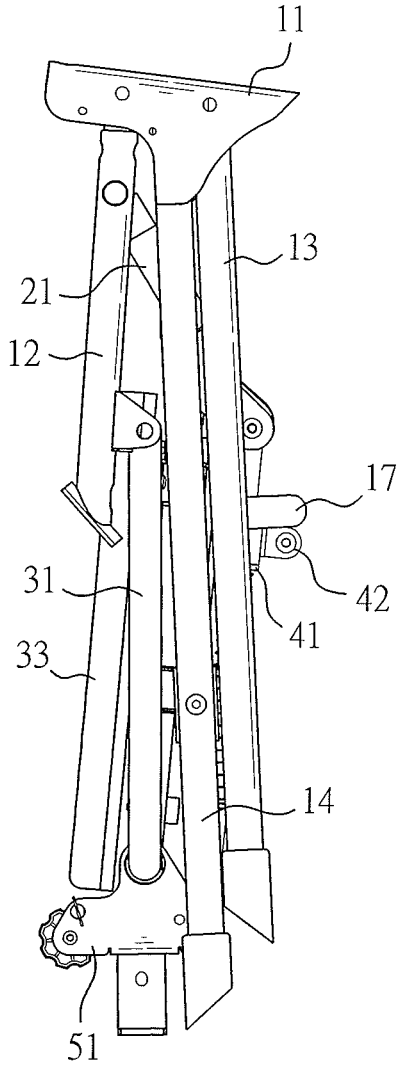
Figure 10:
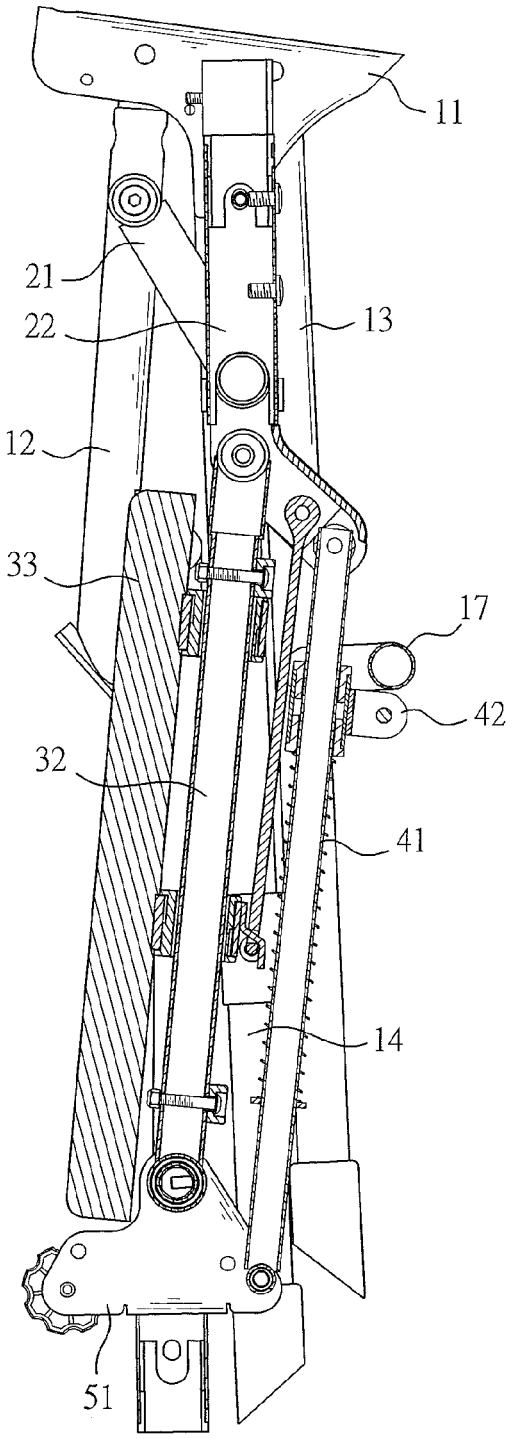
FIG. 10 is a sectional view of the seated inversion table in FIG. 1, shown folded.

Finally, as shown in FIG. 9, the two rear support components 13 are tilted forward until the rear support components 13 are parallel to the front support components 14 to finish the storage process of the present seated inversion table. Then also refer to the FIG. 10, with the curved tube 17 bent backward, when the rear support components 13 are parallel to the front support components 14, the curved tube 17 can step away from the lower connecting tube 41 and make the lower connecting tube 41 accommodated in a curved space of the curved tube 17 to minimize a thickness of the folded seated inversion table.

Consequently, one of the advantages of the present seated inversion table is that with the front swinging rod 31 tiltably mounted on the support frame assembly 10, the front swinging rod 31 will be located at an end of the stroke and abut on the upper bars 1231 when the user performs inversion on the seated inversion table. Thus, a range of an inversion angle is restricted and thereby the seated inversion table may not over tilt. Another advantage of the present seated inversion table is that the connecting tube 15, the back cushion 23 and the foot-clamping assembly 60 are removable, and after the aforesaid components are removed, the present seated inversion table can be folded through tilting the handle components 12, the at least one rear support component 13, the front swinging rod 31, and the sitting cushion 33 to be parallel to the at least one front support component 14. After the removal and folding, the present seated inversion table is adapted to store and thereby decrease occupied space significantly and promote the efficiency of space utilization.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A seated inversion table comprising:

a support frame assembly comprising:

at least one rear support component, at least one front support component connected to the at least one rear support component, and a connecting tube, two opposite ends of the connecting tube securely mounted on the at least one front support component;

a seat back assembly comprising:

a rear swinging rod, two opposite ends of the rear swinging rod tiltably mounted on the support frame assembly, a rear-rod-tilting frame tiltably mounted at a center of the rear swinging rod, and a back cushion securely mounted at one end of the rear-rod-tilting frame;

a seat cushion assembly comprising:

a front swinging rod, two opposite ends of the front swinging rod tiltably mounted on the support frame assembly, a cushion bottom rod, one end of the cushion bottom rod securely mounted on the rear swinging rod of the seat back assembly, and another end of the cushion bottom rod securely mounted on the front swinging rod, and a sitting cushion movably mounted on the cushion bottom rod and the cushion bottom rod located on a bottom surface of the sitting cushion;

a lower connecting tube assembly comprising:

a lower connecting tube located on the bottom surface of the sitting cushion, one end of the lower connecting tube securely mounted at another end of the rear-rod-tilting frame of the seat back assembly, a guiding stand mounted on an outer surface of the lower connecting tube, and a band, one end of the band securely mounted on the connecting tube of the support frame assembly and detoured around the guiding stand;

a rotating frame assembly comprising:

a connecting frame tiltably mounted at a center of the front swinging rod of the seat cushion assembly, another end of the lower connecting tube securely mounted on the connecting frame, another end of the band mounted on the connecting frame, and a foot-clamping frame assembly securely mounted on the rotating frame assembly, and being adjustable in angle and distance relative to the rotating frame assembly.

2. The seated inversion table as claimed in claim 1, wherein the support frame assembly further comprises:

two pivot frames mounted on two sides of the support frame assembly respectively, and two handle components, two lower ends of the two handle components mounted on the two pivot frames respectively; and wherein a number of the at last one rear support component of the support frame assembly is two, two upper ends of the two rear support components mounted on the two pivot frames respectively;

a number of the at last one front support component of the support frame assembly is two, the two front support components securely mounted on the two pivot frames respectively;

the connecting tube of the support frame assembly removably mounted between the two front support components;

the back cushion of the seat back assembly removably mounted on the support frame assembly;

the sitting cushion of the seat cushion assembly tiltably mounted on the support frame assembly; and the foot-clamping frame assembly removably mounted on the rotating frame assembly;

wherein after the connecting tube, the back cushion, and the foot-clamping frame assembly are removed, the two handle components, the two rear support components, and the sitting cushion may be tilted to be parallel to the front support components.

3. The seated inversion table as claimed in claim 2, wherein each one of the two handle components comprises a first fixing element removably mounted through the corresponding pivot frame and being adjacent to the lower end of the corresponding handle component.

4. The seated inversion table as claimed in claim 3, wherein each one of the two handle components comprises a first sleeve securely mounted adjacent to the lower end of the corresponding handle component; the two first fixing elements of the two handle components are two screws removably screwed into the two first sleeves respectively.

5. The seated inversion table as claimed in claim 4, wherein each one of the handle components comprises a handle bar removably mounted on an upper end of the handle component, and a second fixing element removably mounted through the upper end of the handle component and the handle bar.

6. The seated inversion table as claimed in claim 5, wherein the two second fixing elements of the two handle components are two screws screwed into the two handle bars respectively.

7. The seated inversion table as claimed in claim 6, wherein each one of the two front support components comprises a third fixing element removably mounted through one of the front support components and the connecting tube respectively.

8. The seated inversion table as claimed in claim 7, wherein each one of the pivot frames of the support frame assembly comprises:

two sidewalls, the lower ends of the two handle components and the upper ends of the two rear support components tiltably mounted between the two sidewalls of the corresponding pivot frame; and a connecting wall, the lower ends of the two handle components and the upper ends of the two rear support components selectively abutting against the connecting wall of the corresponding pivot frame.

9. The seated inversion table as claimed in claim 8, wherein the support frame assembly further comprises two support covers removably mounted in the two pivot frames respectively and between the corresponding handle component and the corresponding front support component.

10. The seated inversion table as claimed in claim 9, wherein each one of the two support covers forms a plurality of protrusions on an edge of the support cover;

the two sidewalls of the corresponding pivot frame form a plurality of recesses in which the protrusions selectively engage.

11. The seated inversion table as claimed in claim 2, wherein each one of the handle components comprises a handle bar removably mounted on an upper end of the handle component, and a second fixing element removably mounted through the upper end of the handle component and the handle bar.

12. The seated inversion table as claimed in claim 11, wherein the two second fixing elements of the two handle components are two screws screwed into the two handle bars respectively.

13. The seated inversion table as claimed in claim 2, wherein each one of the two front support components comprises a third fixing element removably mounted through one of the front support components and the connecting tube respectively.

14. The seated inversion table as claimed in claim 2, wherein each one of the pivot frames of the support frame assembly comprises:

two sidewalls, the lower ends of the two handle components and the upper ends of the two rear support components tiltably mounted between the two sidewalls of the corresponding pivot frame; and a connecting wall, the lower ends of the two handle components and the upper ends of the two rear support components selectively abutting against the connecting wall of the corresponding pivot frame.

15. The seated inversion table as claimed in claim 14, wherein the support frame assembly further comprises two support covers removably mounted in the two pivot frames respectively and between the corresponding handle component and the corresponding front support component.

16. The seated inversion table as claimed in claim 15, wherein each one of the two support covers forms a plurality of protrusions on an edge of the support cover;

the two sidewalls of the corresponding pivot frame form a plurality of recesses in which the protrusions selectively engage.

17. The seated inversion table as claimed in claim 2, wherein the support frame assembly further comprises a curved tube protruding backward and securely mounted between the two rear support components.

18. The inversion seat as claimed claim 1, wherein the lower connecting tube assembly further comprises a sleeve component movably mounted around an outer surface of the lower connecting tube, and the guiding stand securely mounted on an outer surface of the sleeve component; and a spring mounted around the lower connecting tube, one end of the spring abutting on the sleeve component; another end of the spring abutting on the outer surface of the lower connecting tube.

19. The inversion seat as claimed in claim 1, wherein the band comprises a sleeving portion at said end of the band securely mounted on the connecting frame, and a plurality of separate marks on a surface of the band;

the guiding stand comprises a roller pivotably mounted in the guiding stand; another surface of the band lay on an outer surface of the roller;

the connecting frame is two separate but connected sheet bodies and comprises two rod stands laterally mounted through the two sheet bodies respectively, the rod stands corresponding to each other in locations, the rod stands pivotably mounted in the front swinging rod of the seat cushion assembly; and the rotating frame assembly further comprises an assembling tube, one end of the assembling tube securely mounted on a bottom of the connecting frame, and one end of the foot-clamping frame assembly adjustably mounted on another end of the assembling tube, a knob comprising a stick protruding from a surface of the knob and penetrating through the connecting frame, and an adjusting component pivotably mounted in the connecting frame and including a casing being a hollow tube, mounted around the stick, and forming an elongate opening corresponding to an inside of the casing, wherein the band penetrates the elongate opening and the sleeving portion of the band is inside the casing and is mounted around an outer surface of the stick.

20. The inversion seat as claimed in claim 19, wherein the foot-clamping frame assembly comprises:

a curved linkage tube, one end of the curved linkage tube being a straight segment adjustably mounted on the assembling tube, another end of the curved linkage tube forming a curved segment, the curved linkage tube abuts on the support frame assembly and comprises an adjusting stand mounted on a top surface of the curved segment, and two first foot-clamping components mounted on two lateral surfaces of the straight segment respectively;

a rack piece, one end of the rack piece mounted on the curved linkage tube, the rack piece comprising a toothed portion forming on an edge of the rack piece and facing to the sitting cushion, an adjusting tube being a hollow tube, one end of the adjusting tube tiltably mounted on the adjusting stand, the adjusting tube comprising a cover securely mounted on another end of the adjusting tube, and two second foot-clamping components mounted on two lateral surfaces of the adjusting tube respectively and corresponding to the first foot-clamping components in locations;

an adjusting rod mounted in the adjusting tube, one end of the adjusting rod penetrating through the cover, the adjusting rod comprising an obstruction portion radially protruding from an outer surface of another end of the adjusting rod, and a wedge portion formed on said another end of the adjusting rod, and engaged with the toothed portion of the rack piece; and an adjusting spring mounted around an outer surface of the adjusting rod, one end of the adjusting spring abutting on the obstruction portion, another end of the adjusting spring abutting on the cover.

* * * * *